United States Patent [19]

Lalli

[11] 4,310,008

[45] Jan. 12, 1982

[54] HAIR ROLLER

[76] Inventor: Mary S. Lalli, 113 Deepdale Rd., Strafford-Wayne, Pa. 19087

[21] Appl. No.: 172,568

[22] Filed: Jul. 28, 1980

[51] Int. Cl.[3] ..... A45D 2/00

[52] U.S. Cl. ..... 132/40

[58] Field of Search ..... 132/40, 42 R, 39, 41 R, 132/42 A, 44

[56] References Cited

U.S. PATENT DOCUMENTS

| | | | |
|---|---|---|---|
| 2,563,421 | 8/1951 | Roth | 132/42 R |
| 3,216,427 | 11/1965 | Jefferson | 132/40 |
| 3,426,767 | 2/1969 | Mergorella | 132/40 |

FOREIGN PATENT DOCUMENTS

| | | | |
|---|---|---|---|
| 1317991 | 12/1963 | France | 132/39 |

*Primary Examiner*—Robert Peshock
*Assistant Examiner*—Mickey Yu
*Attorney, Agent, or Firm*—Charles A. McClure

[57] ABSTRACT

An entirely resilient or "soft" hair roller. Tubular netting surrounds a soft cylindrical member and has soft end tabs that are mutually adherent when juxtaposed in contact with one another. These hair rollers can be worn without discomfort even when the wearer's head is resting on a pillow because they lack rigid or semi-rigid elements that might press against the scalp.

13 Claims, 7 Drawing Figures

HAIR ROLLER

This invention relates to improvements in a kind of article about which hair is wrapped to curl it, usually called simply a "hair roller".

Conventional hair rollers cannot be worn comfortably in reclining position because even with the head against a pillow the rollers press uncomfortably against the scalp and may induce headaches or other discomforts. A need has long been felt for an improved hair roller free of such defect. However, structural members of hair rollers have continued to present this problem to successive generations of users, without significant improvement.

A primary object of the present invention is provision of an improved hair roller that can be worn comfortably in any position.

Another object of this invention is simplified construction of a satisfactory hair roller.

A further object of the invention is provision of readily available and detachable securing means for a hair roller.

Other objects of the invention, together with means and methods for attaining the various objects will be apparent from the following description and the accompanying diagrams of embodiments of such an improved hair roller, which are presented by way of example rather than limitation.

In general the objects of this invention are accomplished in a hair roller having a resilient cylindrical member, longitudinal means such as a length of tubular netting capable of surrounding the resilient cylindrical member, and means for securing the opposite ends of the longitudinal means detachably together such as mutually adherent end tabs thereon.

Figure 1:
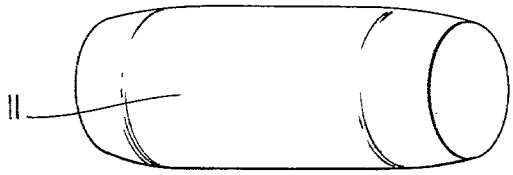
FIG. 1 is a perspective view of a diminutive pillow-like resilient cylindrical member useful in my hair roller.

FIG. 1 shows a first embodiment of resilient cylindrical member 11 in the form of a diminutive pillow, which may be made throughout of foam plastic or rubber or may be hollowed out in the center. This member has no internal or external skeletal members that might serve to stiffen or support it or that might perform other hair roller functions.

Figure 2:
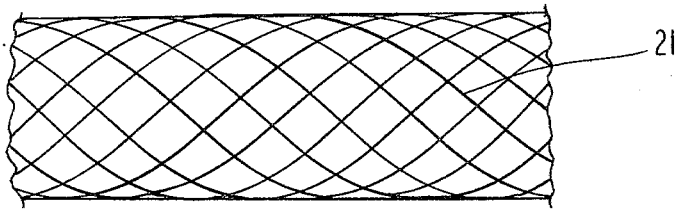
FIG. 2 is a side elevation of a cylindrical length of netting useful in my hair roller.

FIG. 2 shows a first embodiment of longitudinal means 21, in the form of tubular netting, which may be formed by knitting of conventional textile filaments or yarn or by heat-adhesion of angularly overlapped thermoplastic filaments.

Figure 3:
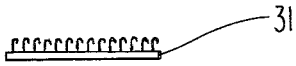
FIG. 3 is a side elevation of an end tab useful in my hair roller.

FIG. 3 is a side elevation of end tab 31, in the form of textile fabric, showing in stylized form (enlarged) a multiplicity of filamentary protrusions with hooked ends.

Figure 4:
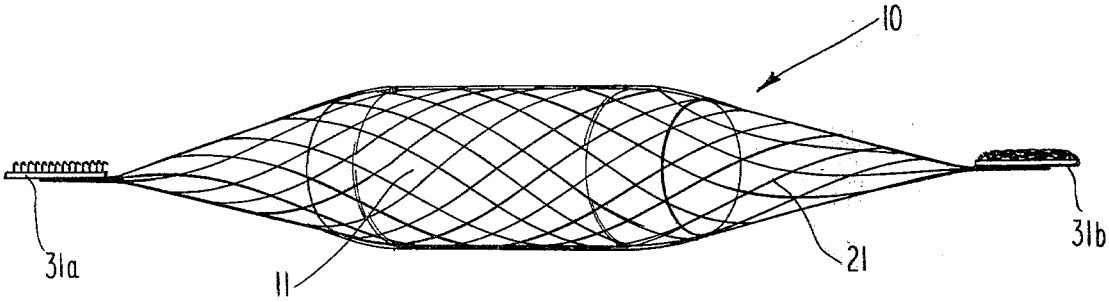
FIG. 4 is a perspective view of a hair roller of the present invention before (or after) being used, having been assembled from members of the preceding views.

FIG. 4 shows, in perspective, a resulting embodiment of hair roller 10 of this invention. Resilient cylindrical member 11 is surrounded by tubular netting 21 with its opposite ends extending beyond the ends of the surrounded member. The ends of the netting are drawn conically together, and have secured adhesively thereto respective end tabs 31*a*, 31*b*. The end tabs comprise specific attachment means and are preferably in the form of textile fabric, at least one of them having a surface characterized similar to the general form of tab 31 aforementioned and both of them being capable of engaging detachably together when juxtaposed into mutual contact.

Figure 5:
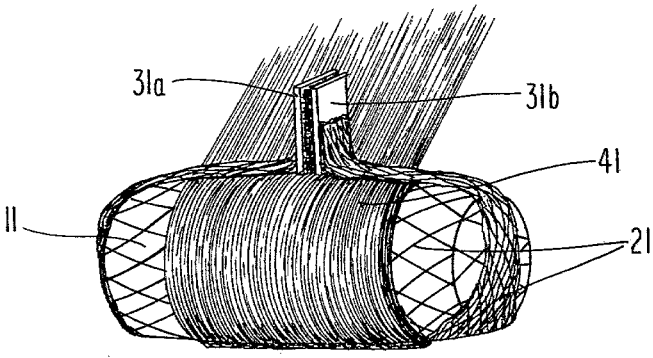
FIG. 5 is a similar view of the same hair roller shown in use, with hair wrapped around it, and secured in place.

FIG. 5 is similar in view to FIG. 4 except that there is hair wrapped around member 11, and the rest of the components are displaced from their respective previous positions and/or orientations to secure it in place. Thus, the opposite ends of the netting are now bent back over the outside surface of the cylindrical member to come together, and end tabs 31*a*, 31*b* carried by the respective opposite netting ends are juxtaposed to one another into adherent contact, thereby confining a bight of hair 41 in place—and, by the same token, securing the hair roller in place on the head of the person whose hair it is.

Use of the hair roller of this invention is readily understood. First the hair roller is juxtaposed to the head of the user or temporary wearer of the hair roller (usually many hair rollers) consecutively with the netting around the resilient member. The ends of the netting are extended in opposite directions beyond the ends of the cylindrical member. Next a lock of hair is wrapped around the cylindrical member (already surrounded by the netting). Then the ends of the netting are folded back over the bight of hair (so wrapped) into juxtaposition to one another. Finally the mutually adherent end tabs on the juxtaposed ends of the netting are pressed together so that their adherent surfaces come into contact with one another and adhere together. Both the hair roller and the hair are thus secured in place relative to one another. The netting aids in keeping the hair from being displaced along the roller.

The end tabs may be separated readily by hand, as by forcing a finger in between to snap them apart, releasing the hair from its retention around the hair roller, and releasing the hair roller from its retention by the hair previously wrapped around it. The entire hair roller assembly can be reused at will and can be washed meanwhile or from time to time as desired.

Figure 6:
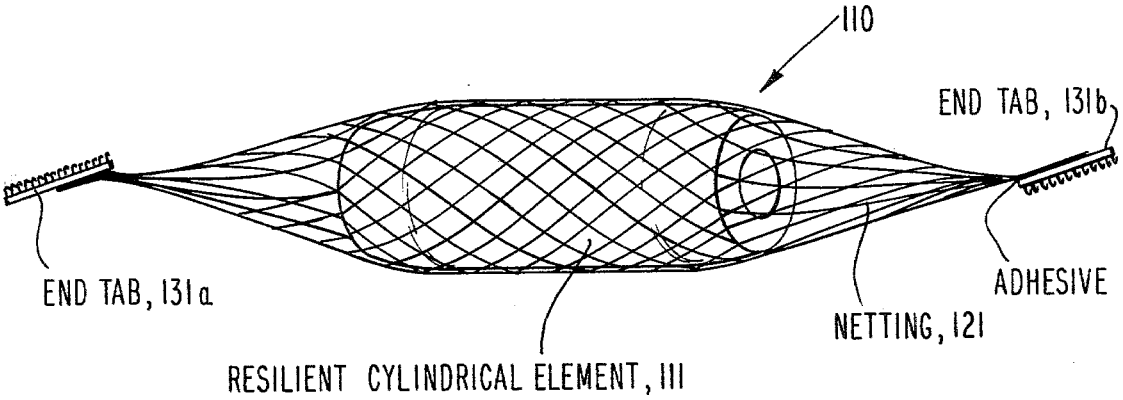
FIG. 6 is a perspective view of a hair roller of my invention at the same stage as in FIG. 4 but containing an alternative hollow or sleeve-like resilient member.
Figure 7:
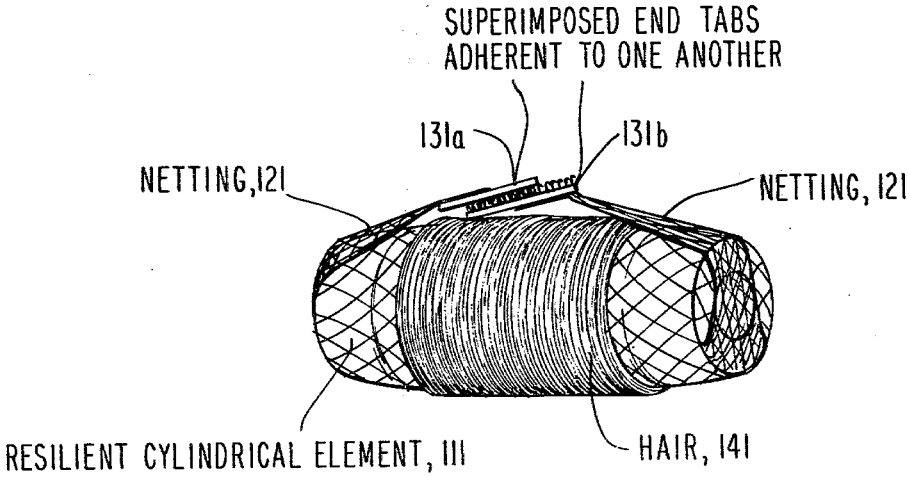
FIG. 7 is a similar view of the hair roller of FIG. 6 at a like stage to FIG. 5 of the preceding embodiment and with the end tabs secured in alternative relationship.

In the embodiment of FIGS. 6 and 7 references to components similar to those of preceding views are designated by like numbers plus a prefixed 1 to convert from a 10 to 99 series to a 100 to 199 series of numerals for ease of reference.

FIG. 6 shows an alternative embodiment of hair roller 110 of this invention. Cylindrical member 111 is in the form of a hollow cylinder or sleeve of resilient material. Netting 121 and end tabs 131*a*, 131*b* are shown similar to the corresponding members of FIG. 4.

FIG. 7 shows the alternative hair roller at a stage corresponding to the FIG. 5 showing of the first embodiment. However, here the end tabs are overlapped head to tail, so to speak, to be flat, rather than in the upstanding head-to-head fashion of the engaged end tabs in that preceding view.

The resilient cylindrical member normally comprises a foam composition, e.g., a natural or synthetic rubber or polymeric foam such as in unfoamed condition is useful in textile filaments or sheet films. An example of a suitable composition is polyurethane, but many others would be suitable as well. The roller may be homogeneous throughout or may be largely hollow inside, with the hollow either confined to the interior or erupting to the ends in toroidal manner, as in the embodiment of FIGS. 7 and 8.

As aleady suggested the netting may be made of synthetic monofils joined in a tubular shape, with at least two sets of filaments, each set in parallel rows crossing the other, either orthogonally or at any substantial angle, and heat-adhered at the crossover nodes. An example of a suitable material is composed of polyvinyl chloride/polyvinylidene chloride copolymer.

Suitable end tab material is also a commonly available textile article, described briefly above. One such material is available from American Velcro, Inc., Manchester, New Hampshire, under the brand name "Velcro" and may be made of polyamide materials. Both end tabs may be alike, or one may be of a simpler plush material suitable for mating engagement therewith.

Although preferred embodiments of hair roller according to this invention have been shown and described by way of example, equivalent means may be substituted, with or without some change in composition, function, or structure. For example, the alternative toroidal cylindrical member may surround the netting or equivalent longitudinal means rather than being surrounded thereby. In that event a closed, rather than open, fabric, yarn, or the like may be employed. The end tabs carried by the ends of the longitudinal member may be replaced by more conventional fastening means or method, as well, in either embodiment.

Other modifications may be made in the article of this invention, as by adding, combining or subdividing parts, while retaining many of the advantages or benefits of the invention, which itself is defined only in the following claims.

The claimed invention:

1. Hair roller comprising resilient cylindrical means, flexible longitudinal means adjoining the cylindrical means and extending in the axial direction beyond opposite ends thereof, the resilient cylindrical means being surrounded circumferentially by the flexibly longitudinal means, attachment means at opposite ends of the longitudinal means and adapted to adhere together detachably when juxtaposed to one another in mutual contact.

2. Hair roller according to claim 1, wherein the cylindrical means is free of any rigid supporting member.

3. Hair roller according to claim 1, wherein the longitudinal means is free of attachment to the resilient cylindrical member.

4. Hair roller according to claim 1, wherein the mutually adherent attachment means comprise textile fabric characterized by a multiplicity of filamentary protrusions from a surface thereof.

5. Hair roller comprising resilient cylindrical means, flexible longitudinal means adjoining the cylindrical means and extending in the axial direction beyond opposite ends thereof, one of the foregoing means being surrounded circumferentially by the other, attachment means at opposite ends of the longitudinal means and adapted to adhere together detachably when juxtaposed to one another in mutual contact, wherein the ends of the longitudinal means are closed with the resilient cylindrical means located subtantially entirely surrounded therein.

6. In a hair roller having a resilient cylindrical member, improved retaining means comprising tubular netting surrounding the resilient cylindrical member and tabs for securing the ends of the netting in juxtaposition to one another.

7. Hair roller according to claim 6, wherein the tubular netting and the resilient cylindrical member are unattached to one another.

8. Hair roller according to claim 6, wherein the resilient cylindrical member comprises cellular foam material.

9. Hair roller according to claim 6, wherein the resilient cylindrical member is hollow.

10. In a hair roller having a resilient cylindrical member and flexible surrounding means comprising plastic netting for retaining the cylindrical member in place, improved attachment means, comprising flexible mutually adherent end tabs for securing the opposite ends of the surrounding means in juxtaposition.

11. Hair roller according to claim 10, wherein the mutually adherent attachment end tabs comprise textile fabric characterized by a multiplicity of filamentary protrusions therefrom.

12. Hair roller according to claim 11, wherein the opposite ends of the surrounding means for retaining the resilient cylindrical member in place each carry a piece of such adherent textile fabric.

13. Hair roller according to claim 10, wherein the plastic netting is resiliently extensible parallel to the axis of the cylindrical member.

* * * * *